US005790142A

United States Patent [19]

Uchinami et al.

[11] Patent Number: 5,790,142

[45] Date of Patent: Aug. 4, 1998

[54] INK JET RECORDING APPARATUS

[75] Inventors: Shunichi Uchinami, Yamaga; Masaharu Oyama, Chikushino; Shinsuke Sato, Fukuoka; Akihiro Yamashita, Saga-ken; Hirokazu Ikeda; Tomoyuki Noguchi, both of Fukuoka, all of Japan

[73] Assignee: Matsushita Electric Industrial Co., Ltd.

[21] Appl. No.: 530,719

[22] Filed: Sep. 15, 1995

[30] Foreign Application Priority Data

Oct. 6, 1994 [JP] Japan ..... 6-242786

[51] Int. Cl.[6] ..... B41J 2/205

[52] U.S. Cl. ..... 347/15; 347/57; 347/61

[58] Field of Search ..... 347/61, 56, 54, 347/20, 1, 183, 192, 9, 15, 10, 57

[56] References Cited

U.S. PATENT DOCUMENTS

| | | | |
|---|---|---|---|
| 3,179,042 | 4/1965 | Naiman . | |
| 5,400,061 | 3/1995 | Horio et al. | 347/61 |
| 5,420,618 | 5/1995 | Sekiya et al. | 347/9 |

*Primary Examiner*—Benjamin R. Fuller
*Assistant Examiner*—Juanita Dionne Stephens
*Attorney, Agent, or Firm*—Stevens, Davis, Miller & Mosher, L.L.P.

[57] ABSTRACT

By increasing/deceasing electric energy per unit time supplied to heat energy generation means arranged in a liquid chamber having a nozzle, the amount of the ink emitted from the nozzle can be changed to correct a difference in dot diameter which occurs nozzle by nozzle and a change in dot diameter with time and to permit gradational printing.

16 Claims, 8 Drawing Sheets

INK JET RECORDING APPARATUS

BACKGROUND OF THE INVENTION

1. Field of the Invention

The present invention relates to an ink jet recording apparatus used for printing outputs of an office computer or a personal computer and more particularly to an ink jet recording apparatus in which boiling bubbles are generated in ink by heat and the ink is emitted by pressure of the boiling bubbles.

2. Description of the Related Art

In recent years, because of its quiet operation during printing, an ink jet recording apparatus has been utilized widely as an output printer of the office computer.

A conventional ink jet recording apparatus will be described hereunder.

FIG. 13 is a sectional view of the conventional ink jet recording apparatus and FIG. 14 is a plan view showing the conventional ink jet recording apparatus in which its sheet formed with a nozzle is removed.

Referring to FIGS. 13 and 14, electrodes 1 and 2 are adapted to pass an electric current through ink 8 contained in an opening 5, leads 3 are used for supplying electric power to the electrodes 1 and 2, an insulating film 4 made of an organic material or ceramics, etc. covers the leads 3, the electrodes 1 and 2 and the leads 3 are formed on a ceramic substrate 6 of, for example, silicon or glass, a nozzle 9 is opened in a sheet 7 of, for example, an organic material, a power supply 10 supplies electric power to the electrodes 1 and 2 through wiring conductors 12 and the leads 3, and an electric conduction switching means 11 controls electric power supplied from the power supply 10 to the electrodes 1 and 2.

The conventional ink jet recording apparatus constructed as above operates as described below.

When electric power is supplied from the power supply 10 to the electrodes 1 and 2 by means of the electric conduction switching means 11, an electric current is passed to ink 8 contained in the opening 5. Joule heat is generated by this electric current in the ink 8, and the ink 8 is boiled. The boiling pressure causes the ink 8 to be emitted from the nozzle 9 so as to be deposited on, for example, recording paper.

While the conventional apparatus can merely perform recording by emitting ink 8, it cannot perform gradational recording by changing the amount of emitted ink and it cannot apply feedback when irregularity in the amount of emitted ink occurs due to certain causes, resulting in a failure to maintain the amount of emitted ink at a stable value.

SUMMARY OF THE INVENTION

An object of the present invention is to provide an ink jet recording apparatus capable of performing gradational recording or uniform recording of an image.

To accomplish the above object, according to the present invention, in an ink jet recording apparatus in which ink contained in a liquid chamber having a nozzle is boiled by heat energy generation means arranged in the liquid chamber and pressure of boiling bubbles causes the ink to be emitted from the nozzle, power control means is provided for increasing/decreasing electric energy per unit time supplied to the heat energy generation means, whereby the size of boiling bubbles generated in the liquid chamber can be changed to change the amount of the ink emitted from the nozzle by increasing/decreasing electric energy per unit time supplied to the heat energy generation means.

DESCRIPTION OF THE PREFERRED EMBODIMENTS

Figure 1:
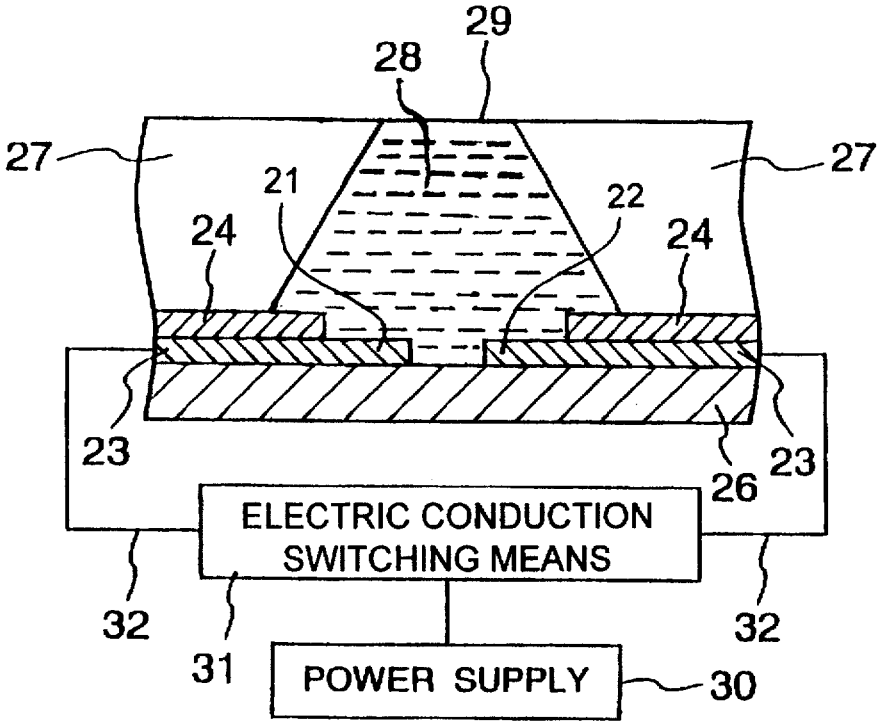
FIG. 1 is a sectional view showing an embodiment of an ink jet recording apparatus according to the present invention.
Figure 2:
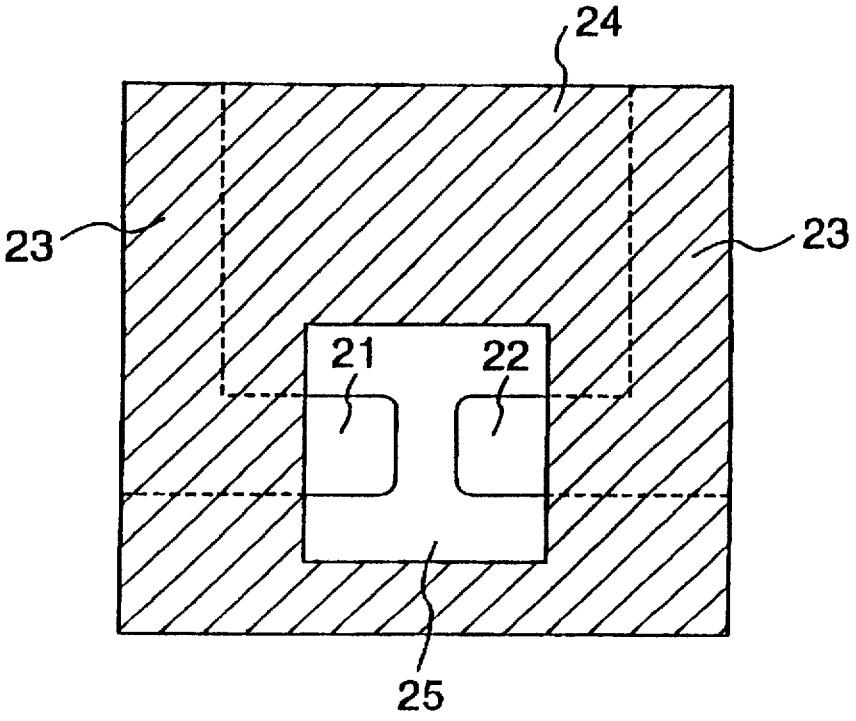
FIG. 2 is a plan view showing the FIG. 1 embodiment in which its sheet formed with a nozzle is removed.

FIG. 1 is a sectional view showing an embodiment of an ink jet recording apparatus according to the present invention, and FIG. 2 is a plan view showing this ink jet recording apparatus in which its sheet formed with a nozzle is removed.

In the present embodiment, a glass substrate is used as a substrate 26 and an electrically conductive metal film of titanium is formed on the substrate 26 through sputtering process. The metal film is then patterned by photolithographic technique to form leads 23 and electrodes 21 and 22. More specifically, photosensitive resin is coated on the titanium film formed through sputtering, and a mask plate of chromium hollowed at portions of the leads 23 and electrodes 21 and 22, which mask plate has been prepared in advance, is put on the coating. Then, they are exposed to ultraviolet rays so that the resin not exposed at the portion other than the leads 23 and electrodes 21 and 22 is removed by chemical etching. Further, a resulting structure is chemically etched using a solvent having ability to solve titanium to remove titanium at the portion other than the leads 23 and electrodes 21 and 22.

Next, a portion other than the electrodes 21 and 22 and their neighborhood is covered with an insulating film 24. More specifically, insulative and photosensitive resin is uniformly coated by spinning coating on the titanium films of leads 23 and electrodes 21 and 22 and the substrate 26, and a mask plate of chromium prepared separately is used for exposing a portion other than an opening portion 25 to ultraviolet rays, followed by removal of the resin at the opening portion 25 through chemical etching.

Finally, a resin sheet 27 formed with an opening of a nozzle 29 is bonded to the insulating film 24.

Electrical conduction from a power supply 30 to the electrodes 21 and 22 is effected through wiring conductors 32 by means of an electric conduction switching means 31.

With this construction, ink 28 in contact with the electrodes 21 and 22 is caused to boil so as to be emitted from the nozzle 29.

In the present embodiment, each of the electrodes 21 and 22 has a thickness of 1 μm, the insulating film 24 has a thickness of 2 μm, the resin sheet 27 has a thickness of 100 μm, each of the electrodes 21 and 22 has a width of 30 μm, the distance between the electrodes 21 and 22 is 10 μm, and the size of the opening portion 25 is 60 μm×60 μm.

The tip edge of each of the electrodes 21 and 22 is rounded at a suitable curvature.

To ensure that the present embodiment operates as the ink jet recording apparatus, an ends of leads 23 opposite to the electrodes 21 and 22 are provided with contacts connectable to flexible terminals to which drive voltages are applied externally.

Next, the application of signals to the electrodes 21 and 22 will be described. Each of the signals may be an AC signal, which may have a sine wave form or a rectangular form, or a pulse signal.

An instance will be first described where the amplitude of voltages of signals applied to the electrodes 21 and 22 is changed to change the amount of ink 28 to be emitted from the nozzle 29.

Figure 3:
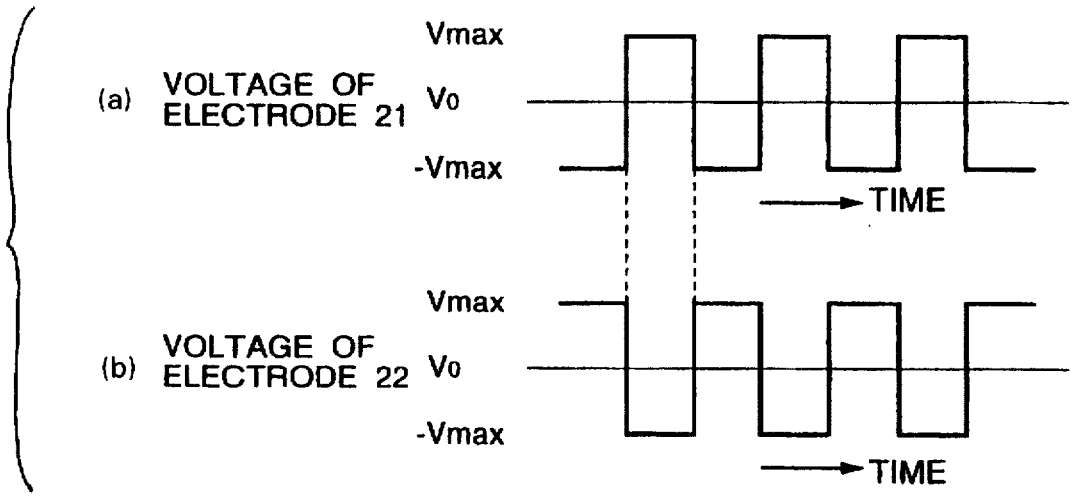
FIG. 3 is a waveform diagram of an example of voltages (a) and (b) applied to a pair of electrodes of the apparatus when an ink stream of an ordinary size is emitted from the nozzle in the FIG. 1 embodiment.
Figure 4:
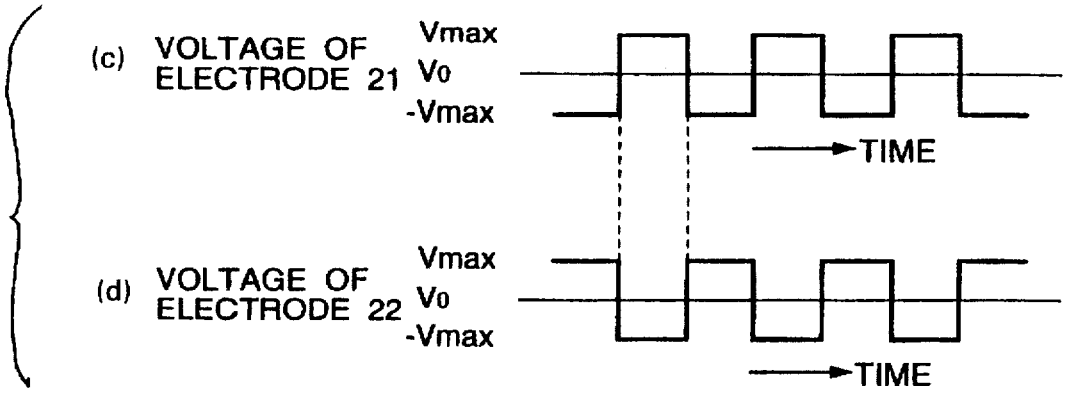
FIG. 4 is a waveform diagram of an example of voltages (c) and (d) applied to the pair of electrodes when an ink stream of a larger size than the ordinary size is emitted from the nozzle in the FIG. 1 embodiment.

FIG. 3 is a waveform diagram of voltages (a) and (b) applied to the electrodes 21 and 22 when a stream of ink 28 of an ordinary size is emitted from the nozzle 29, and FIG. 4 is a waveform diagram of voltages (c) and (d) applied to the electrodes 21 and 22 when a stream of ink 28 of a larger size than the ordinary size is emitted from the nozzle 29. Absolute values of Vmax and−Vmax in the voltage waveform are smaller in FIG. 4 than in FIG. 3.

Figure 7:
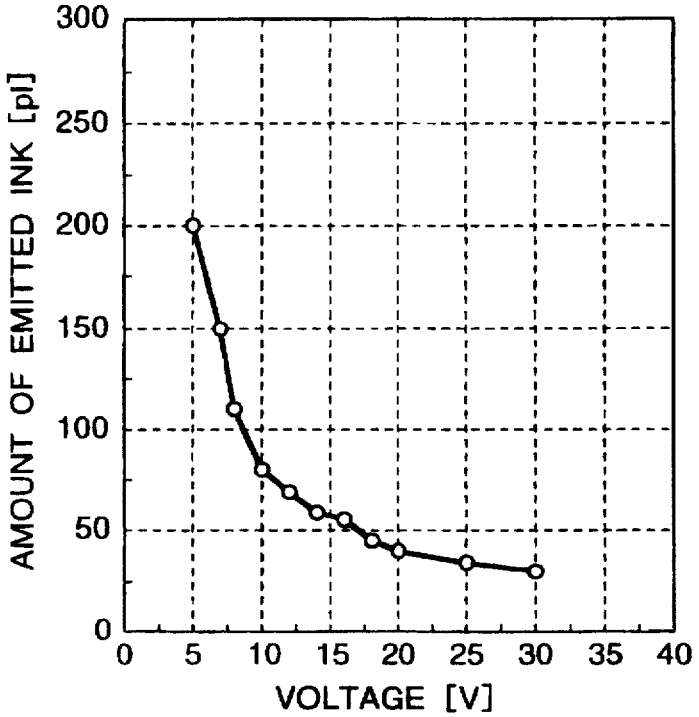
FIG. 7 is a graph showing a relation between a voltage applied between the pair of electrodes and the amount of emitted ink in the FIG. 1 embodiment.

As is clear from the relation shown in FIG. 7 between the voltage applied between the electrodes 21 and 22 and the amount of emitted ink, the smaller the voltage applied between the electrodes 21 and 22, the longer the time required for ink 28 to start boiling becomes, making the size of boiling bubbles larger and so making the amount of emitted ink larger.

Conversely, the larger the voltage, the shorter the time required for ink 28 to start boiling becomes, making the size of boiling bubbles smaller and so making the amount of emitted ink smaller.

Next, an instance will be described where the amount of ink emitted from the nozzle 29 is changed by shifting the phase between the voltages applied to the electrodes 21 and 22.

Figure 5:
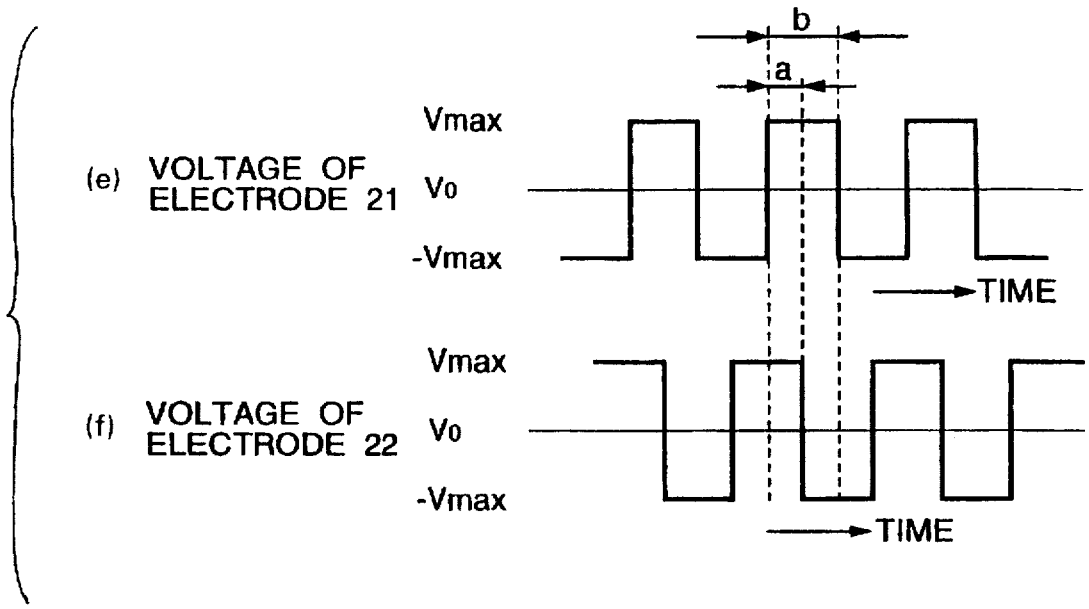
FIG. 5 is a waveform diagram of another example of voltages (e) and (f) applied to the pair of electrodes when an ink stream of a larger size than the ordinary size is emitted from the nozzle in the FIG. 1 embodiment.

FIG. 5 is a waveform diagram of voltages (e) and (f) applied to the electrodes 21 and 22 when a stream of ink 28 of a larger size than the ordinary size is emitted from the nozzle 29. In the waveform of FIG. 3, the phase of voltage applied to the electrode 22 is inverse to that of voltage applied to the electrode 21 but in the waveform of FIG. 5, the phase of voltage applied to the electrode 22 is not exactly inverse to that of voltage applied to the electrode 21 but is shifted from the inverse phase by a period "a".

Figure 8:
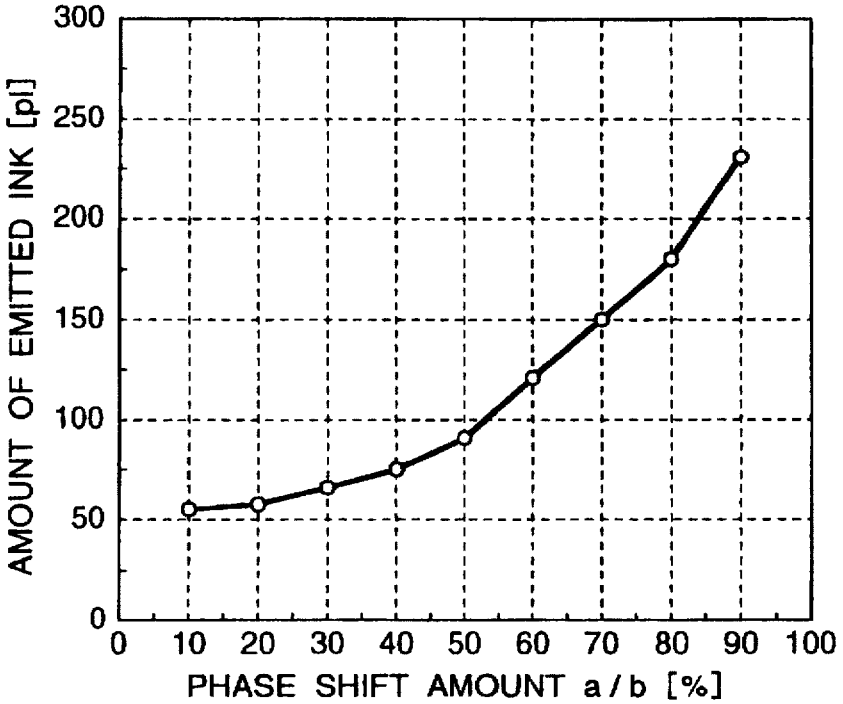
FIG. 8 is a graph showing how the amount of phase shift between voltages applied to the pair of electrodes is related to the amount of emitted ink in the FIG. 1 embodiment.

Current is passed between the electrodes 21 and 22 only when voltage on the electrode 22 is inverse to that on the electrode 21. Therefore, as is clear from the relation shown in FIG. 8 between the mutual phase shift amount (a/b shown in FIG. 5) of voltages applied to the electrodes 21 and 22 and the amount of emitted ink, the larger the mutual phase shift amount (a/b) of voltages applied to the electrodes 21 and 22, the smaller the ratio of current allowed to pass per unit time between the electrodes 21 and 22 becomes. The current is owing to the inversion of the voltage on electrode 22 to the voltage on electrode 21. Thus, the time required for ink 28 to start boiling becomes longer to make the size of boiling bubbles larger and the amount of emitted ink becomes larger.

Finally, an instance will be described where the amount of ink emitted from the nozzle 29 is changed by changing the ratio between positive and negative periods of voltage applied to each of the electrodes 21 and 22.

Figure 6:
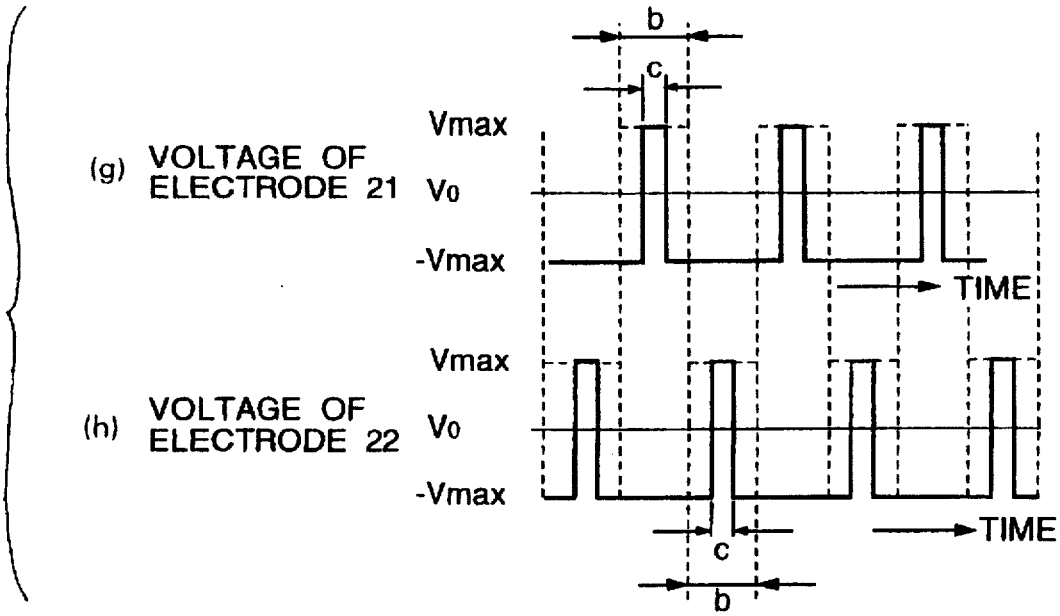
FIG. 6 is a waveform diagram of still another example of voltages (g) and (h) applied to the pair of electrodes when an ink stream of a larger size than the ordinary size is emitted from the nozzle in the FIG. 1 embodiment.

FIG. 6 is a waveform diagram of voltages (g) and (h) applied to the electrodes 21 and 22 when a stream of ink 28 of a larger size than the ordinary size is emitted from the nozzle 29. In the waveform of FIG. 3, a ratio between positive and negative periods of a voltage applied to each of the electrodes 21 and 22 is 1:1, but in the waveform of FIG. 6, the positive period of the voltage applied to each of the electrodes 21 and 22 is changed to c/b as compared with that in FIG. 3.

Figure 9:
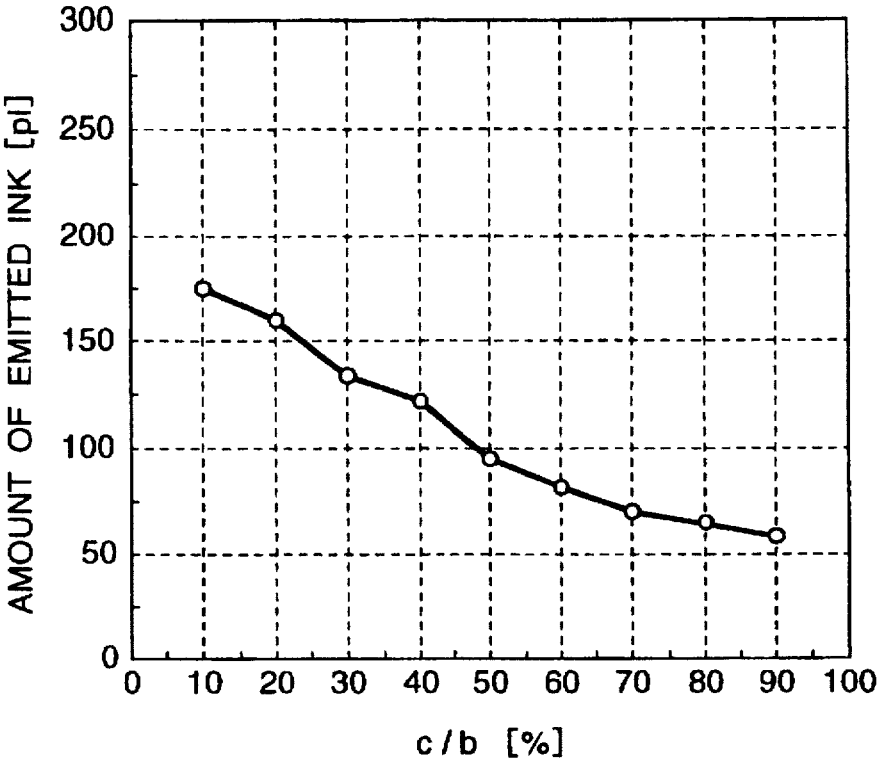
FIG. 9 is a graph showing a relation between the amount of emitted ink and a ratio c/b of a positive period of a voltage applied to each of the pair of electrodes, as compared with the case where the ratio of the positive period to the negative period of the voltage applied to each of the pair of electrodes is 1:1, in the FIG. 1 embodiment.

As explained previously, an electric current is passed between the electrodes 21 and 22 only when voltage applied to one of the electrodes 21 and 22 is inverse to that applied to the other of the electrodes 21 and 22. Thus, as is clear from the relation shown in FIG. 9 between the amount of emitted ink and the ratio c/b of the positive period of the voltage applied to each of the electrodes 21 and 22 as compared with the case where the ratio of the positive period to the negative period of the voltage applied to each of the electrodes 21 and 22 is 1:1, the smaller the ratio c/b changes, the smaller the ratio of an electric current allowed to pass per unit time between the electrodes 21 and 22 owing to the inversion of the voltage on the electrode 22 to the voltage on the electrode 21 becomes, thereby making the time required for ink 28 to start boiling longer to make the size of boiling bubbles larger and making the amount of emitted ink larger.

In any instance, voltages at a frequency of 1 MHz are applied to the electrodes and Vmax of voltage is 10 volts in the examples of FIGS. 5 and 6.

As described above, according to the present invention, in the ink jet recording apparatus in which ink is contained in the liquid chamber having the nozzle is boiled by heat energy generation means arranged in the liquid chamber and pressure of boiling bubbles causes the ink to be emitted from the nozzle, power control means is provided for increasing/decreasing electric power per unit time supplied to the heat energy generation means, whereby the size of boiling bubbles generated in the liquid chamber can be changed to change the amount of the ink emitted from the nozzle by increasing/decreasing electric energy per unit time supplied to the heat energy generation means, thereby ensuring that irregularity in the amount of emitted ink is controlled to permit stable and uniform printing or gradational recording.

An arrangement will now be described which can solve a drawback caused when electric power per unit time supplied to the heat energy generation means is increased/decreased to change the size of boiling bubbles generated in the liquid chamber so as to change the amount of the ink emitted from the nozzle.

When electric power per unit time supplied to the heat energy generation means is increased/decreased to change the size of boiling bubbles generated in the liquid chamber so as to change the amount of the ink emitted from the nozzle, there occurs such a drawback as causing the time required for the ink to start boiling to change. As a result of a change in the time required for the ink to start boiling, timings for emitting ink differ for individual nozzles when a plurality of nozzles are employed. Accordingly, when a gradational ruled line, for example, is printed, a straight line segment is indented.

An arrangement for eliminating the above drawback will now be described.

Figure 11:
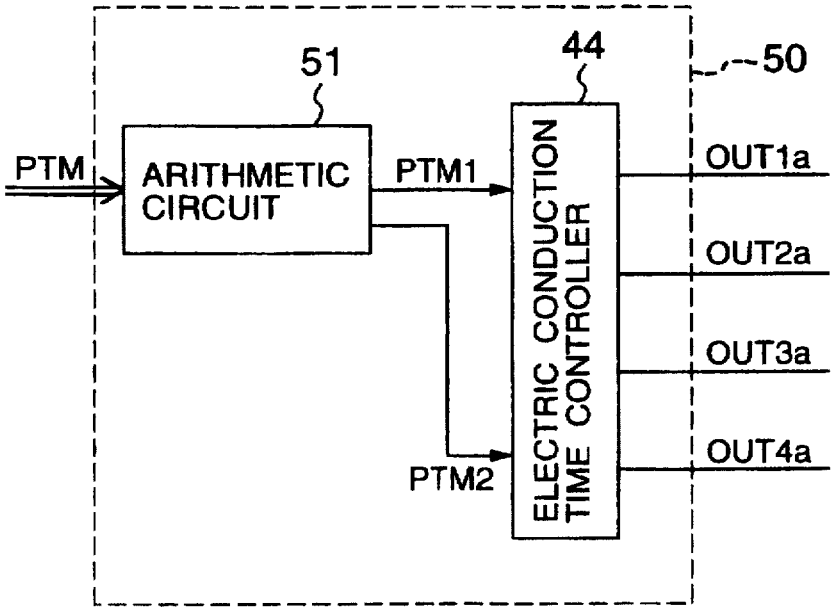
FIG. 11 is a block diagram of an application start timing control unit forming a part of the FIG. 10 arrangement.
Figure 10:
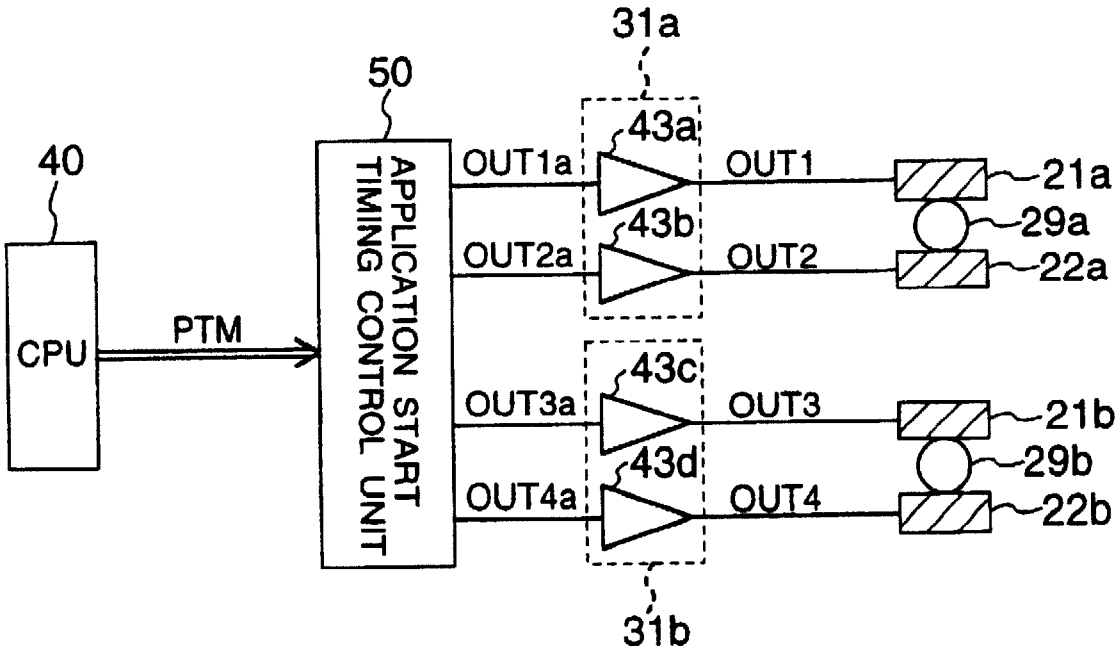
FIG. 10 is a block diagram of an embodiment of an ink jet recording apparatus arrangement according to the present invention.
Figure 12:
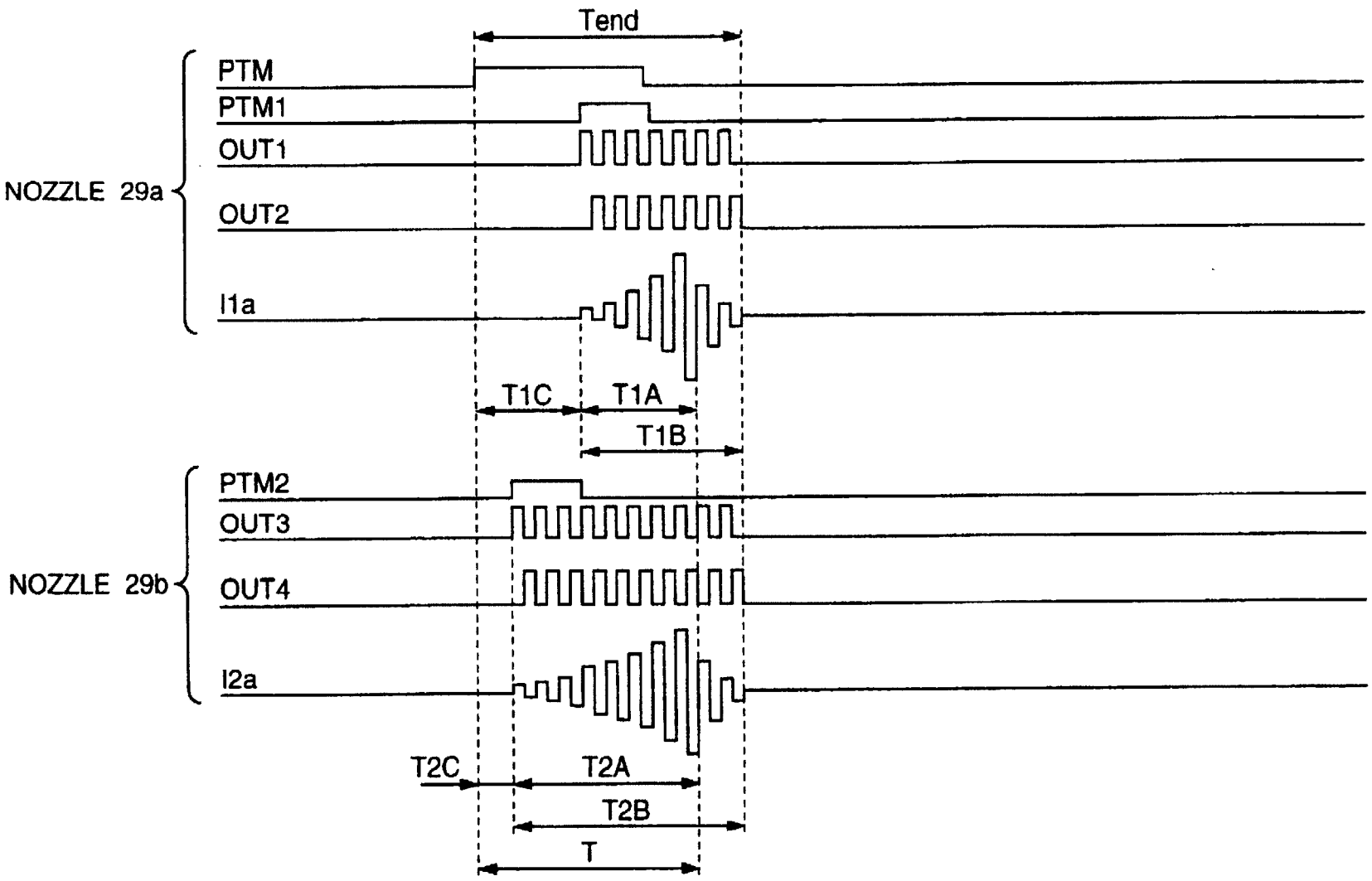
FIG. 12 is a timing chart for the FIG. 10 arrangement.
Figure 13:
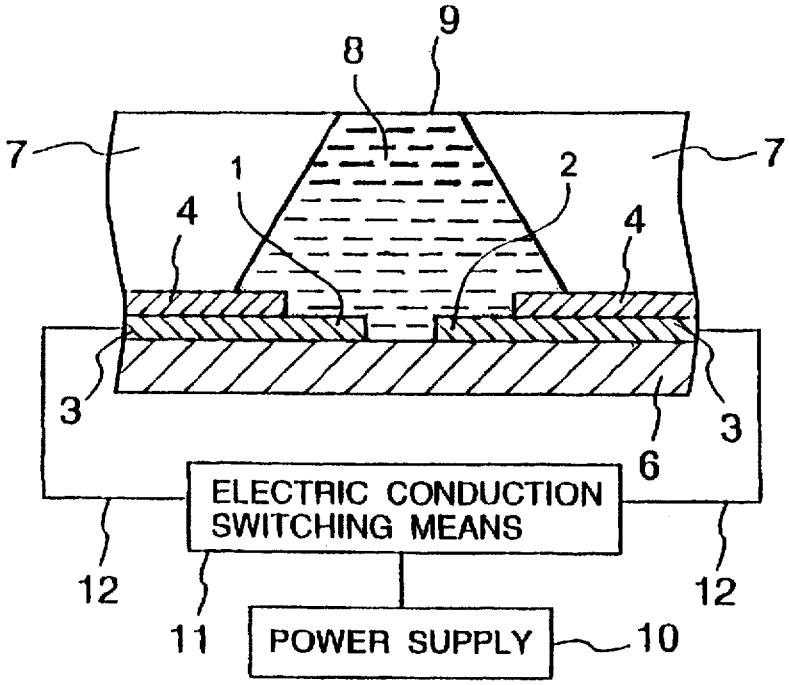
FIG.13 PRIOR ART
FIG. 13 is a sectional view of the conventional ink jet recording apparatus.
Figure 14:
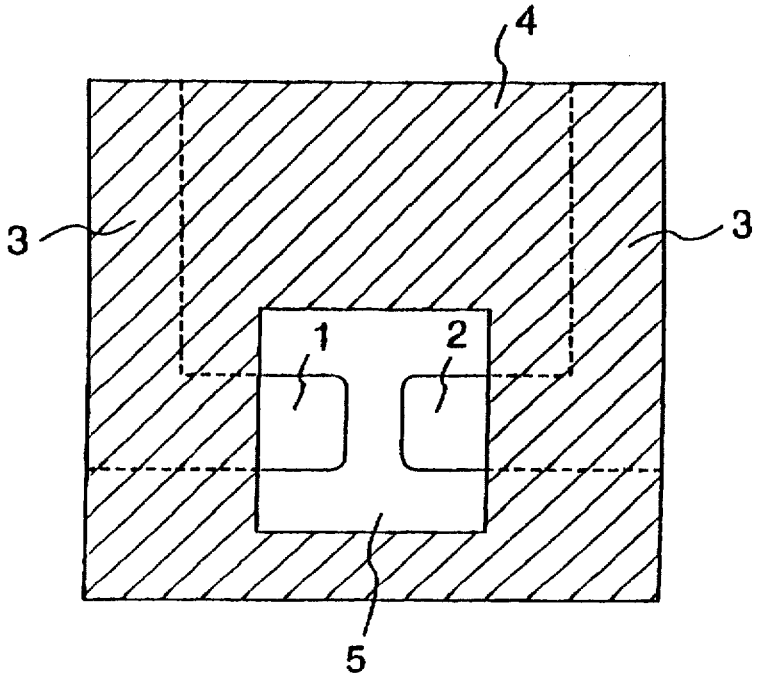
FIG.14 PRIOR ART
FIG. 14 is a plan view showing the conventional ink jet recording apparatus in which its sheet formed with a nozzle is removed.

FIG. 10 is a block diagram of an embodiment of an ink jet recording apparatus arrangement (a plurality of nozzles are employed) according to the present invention, FIG. 11 is a block diagram of an application start timing control unit forming a part of the FIG. 10 arrangement, and FIG. 12 is a timing chart for the FIG. 10 arrangement.

Referring to FIG. 10, the arrangement comprises a pair of electrodes 21*a* and 22*a*, a pair of electrodes 21*b* and 22*b*, a nozzle 29*a* provided in association with the pair of electrodes 21*a* and 22*a*, a nozzle 29*b* provided in association with the pair of electrodes 21*b* and 22*b*, electrode drive units 43*a*, 43*b*, 43*c* and 43*d* which generate signals OUT1–OUT4 for driving the electrodes 21*a*, 22*a*, 21*b* and 22*b*, respectively, a pair of the electrode drive units 43*a* and 43*b* constituting electric conduction switching means 31*a* and a pair of the electrode drive units 43*c* and 43*d* constituting electric conduction switching means 31*b* whereby the electric conduction switching means 31 shown in FIG. 1 represents each of the means 31*a* and 31*b*, a CPU 40 for generating a printing signal PTM, and an application start timing control unit 50 which receives the signal PTM from the CPU 40 to deliver to each of the electrode drive units 43*a*, 43*b*, 43*c* and 43*d* signals OUT1*a*–OUT4*a* for changing the application start timing, the application start timing control unit specifically including an arithmetic circuit 51 and an electric conduction time controller 44 as shown in FIG. 11.

The ink jet recording apparatus arrangement constructed as above operates to emit ink 28 as will be described below with reference to FIG. 12.

Emitting operation at the nozzle 29*a* will first be described. The CPU 40 delivers to the application start timing control unit 50 a signal PTM for informing start of printing. Responsive to this signal, the application start timing control unit 50 calculates an application start timing in accordance with an amount of the ink to be emitted from the nozzle 29*a* such that a period for applying voltages to the nozzle 29*a* ends at the expiration of a period Tend following the timing for rise of the signal PTM.

More specifically, the arithmetic circuit 51 generates an application start signal PTM1 for starting the application of voltages to the nozzle 29*a* on the basis of a necessary application period T1B designated in advance to the nozzle 29*a* and the period Tend. The timing for generating the signal PTM1 is at the expiration of a period T1C following the timing for rise of the signal PTM and can be determined by T1C=Tend T1B.

In the manner as above, the arithmetic circuit 51 delivers the signal PTM1 to the electric conduction time controller 44. Thus, the electric conduction time controller 44 drives the electrode drive units 43*a* and 43*b* in synchronism with the rise of the signal PTM1 during the preset application period T1B. Consequently, a high frequency AC current I1a as shown in FIG. 12 passes through ink 28 contained in the space between the electrodes 21*a* and 22*a* so that boiling bubbles may be generated at the expiration of a period T1A following the rise of the signal PTM1 and the ink 28 may be emitted from the nozzle 29*a*. The high frequency AC current increases as the temperature of ink 28 becomes high, and then, it ceases when boiling bubbles are generated.

Next, emitting operation at the nozzle 29*b* will be described. Like the emitting operation at the nozzle 29*a*, the CPU 40 delivers to the application start timing control unit 50 the signal PTM for informing start of printing. Responsive to this signal, the application start timing control unit 50 calculates an application start timing in accordance with an amount of the ink to be emitted from the nozzle 29*b* such that a period for applying voltages to the nozzle 29*b* ends at the expiration of the period Tend following the timing for rise of the signal PTM.

More specifically, the arithmetic circuit 51 generates an application start signal PTM2 for starting the application of voltages to the nozzle 29*b* on the basis of a necessary application period T2B designated in advance to the nozzle 29*b* and the period Tend. The timing for generating the signal PTM2 is at the expiration of a period T2C following the timing for the rise of the signal PTM and can be determined by T2C=Tend–T2B.

In the manner as above, the arithmetic circuit 51 delivers the signal PTM2 to the electric conduction time controller 44. Thus, the electric conduction time controller 44 drives the electrode drive units 43*c* and 43*d* in synchronism with the rise of the signal PTM2 during the preset application period T2B. Consequently, a high frequency AC current I2*a* as shown in FIG. 12 passes through ink 28 contained in the space between the electrodes 21*b* and 22*b* so that boiling bubbles may be generated at the expiration of a period T2A following the rise of the signal PTM2 and the ink 28 may be emitted from the nozzle 29*b*.

As described above, even when the time for electric conduction for ink 28 between the electrodes 21*a* and 22*a* associated with the nozzle 29*a* differs from that between the electrodes 21*b* and 22*b* associated with the nozzle 29*b*, the ink 28 can be emitted from both of the nozzles 29*a* and 29*b* at the expiration of the same period T following the rise of the printing signal PTM and hence the ink 28 can impinge on the recording paper without misalignment and the straight line segment can be prevented from being indented even when a gradational ruled line is printed.

We claim:

1. An ink jet recording apparatus comprising:

heat energy generation means, adapted to be arranged in a liquid chamber containing ink and having a nozzle, for boiling said ink contained in said liquid chamber to form bubbles, wherein pressure of said bubbles causes a droplet of the ink to be emitted from said nozzle; and power control means for controlling electric energy supplied to said heat energy generation means to adjust a size of said droplet for gradational recording, said power control means supplying said heat energy generation means with less electric energy per unit time for a longer time period to generate larger boiling bubbles and with more electric energy per unit time for a shorter time period to generate smaller boiling bubbles.

2. An ink jet recording apparatus according to claim 1, wherein said power control means controls the electric energy supplied to said heat energy generation means by changing values of voltages of said electric energy.

3. An ink jet recording apparatus comprising:

a pair of electrodes, adapted to be arranged in a liquid chamber containing ink and having a nozzle, for passing an electric current through said ink contained in said liquid chamber to boil the ink to form bubbles, wherein pressure of said bubbles causes a droplet of the ink to be emitted from said nozzle; and power control means for controlling electric energy supplied to said pair of electrodes to adjust a size of said droplet for gradational recording, said power control means supplying said pair of electrodes with less electric energy per unit time for a longer time period to generate larger boiling bubbles and with more electric energy per unit time for a shorter time period to generate smaller boiling bubbles.

4. An ink jet recording apparatus according to claim 3, wherein said power control means controls the electric energy supplied to said pair of electrodes by changing values of voltages of said electric energy.

5. An ink jet recording apparatus comprising:

a pair of electrodes for being supplied with AC voltages and adapted to be arranged in a liquid chamber containing ink and having a nozzle, for passing an electric current through said ink contained in said liquid chamber to boil the ink to form bubbles, wherein pressure of said bubbles causes a droplet of the ink to be emitted from said nozzle; and power control means for controlling said AC voltages supplied to said pair of electrodes to adjust a size of said droplet for gradational recording, said power control means supplying said pair of electrodes with less electric energy per unit time for a longer time period to generate larger boiling bubbles and with more electric energy per unit time for a shorter time period to generate smaller boiling bubbles.

6. An ink jet recording apparatus according to claim 5, wherein said power control means controls the electric energy supplied to said pair of electrodes by changing values of AC voltages of said electric energy.

7. An ink jet recording apparatus comprising:

a pair of electrodes for being supplied with pulse voltages of mutually inverse phases and adapted to be arranged in a liquid chamber containing ink and having a nozzle, for passing an electric current through said ink contained in said liquid chamber to boil the ink to form bubbles, wherein pressure of said bubbles causes a droplet of the ink to be emitted from said nozzle; and power control means for controlling said pulse voltages of mutually inverse phases supplied to said pair of electrodes to adjust a size of said droplet for gradational recording, said power control means supplying said pair of electrodes with less electric energy per unit time for a longer time period to generate larger boiling bubbles and with more electric energy per unit time for a shorter time period to generate smaller boiling bubbles.

8. An ink jet recording apparatus according to claim 7, wherein said power control means controls the electric energy supplied to said pair of electrodes by changing values of pulse voltages of said electric energy.

9. An ink jet recording apparatus according to claim 7, wherein said power control means controls the electric energy supplied to said pair of electrodes by changing the phase difference between said pulse voltages.

10. An ink jet recording apparatus according to claim 7, wherein said power control means controls the electric energy supplied to said pair of electrodes by changing the pulse width of one of said pulse voltages.

11. An ink jet recording apparatus comprising:

a plurality of liquid chambers containing ink and each including a nozzle and heat energy generation means for boiling said ink contained in said liquid chamber to form bubbles, whereby pressure of said bubbles causes a droplet of the ink to be emitted from said nozzle;

a plurality of power control means for controlling electric energy supplied to respective heat energy generation means of said plurality of liquid chambers to adjust a size of said droplet for gradational recording, said plurality of power control means supplying said respective heat energy generation means of said plurality of liquid chambers with less electric energy per unit time for a longer time period to generate larger boiling bubbles and with more electric energy per unit time for a shorter time period to generate smaller boiling bubbles; and application start timing control means for controlling start timing for supply of said electric energy controlled by said plurality of power control means to said respective heat generation means such that the supply of said electric energy controlled by said plurality of power control means to said respective heat energy generation means ends at a same timing.

12. An ink jet recording apparatus according to claim 11, wherein said plurality of power control means controls the electric energy supplied to said respective heat energy generation means by changing values of voltages of said electric energy.

13. An ink jet recording apparatus comprising:

a plurality of liquid chambers containing ink and each including a nozzle and a pair of electrodes, said electrodes having applied thereto pulse voltages of mutually inverse phases and passing an electric current through said ink contained in said liquid chamber to boil the ink to form bubbles, whereby pressure of said bubbles causes a droplet of the ink to be emitted from said nozzle;

a plurality of power control means for controlling said pulse voltages of mutually inverse phases supplied to said pairs of electrodes respectively to adjust a size of said droplet for gradational recording, said plurality of power control means supplying respective pairs of electrodes of said plurality of liquid chambers with less electric energy per unit time for a longer time period to generate larger boiling bubbles and with more electric energy per unit time for a shorter time period to generate smaller boiling bubbles; and application start timing control means for controlling start timing for supply of said pulse voltages controlled by said plurality of power control means to said pairs of electrodes such that the supply of said pulse voltages controlled by said plurality of power control means to said pairs of electrodes ends at a same timing.

14. An ink jet recording apparatus according to claim 13, wherein said plurality of power control means controls the electric energy supplied to said pairs of electrodes by changing values of voltages of said electric energy.

15. An ink jet recording apparatus according to claim 13, wherein each of said plurality of power control means controls the electric energy supplied to respective one of said pairs of electrodes by changing a phase difference between said pulse voltages.

16. An ink jet recording apparatus according to claim 13, wherein each of said plurality of power control means controls the electric energy supplied to a respective one of said pairs of electrodes by changing a pulse width of one of said pulse voltages.

* * * * *